US005205103A

United States Patent [19]

Burton

[11] Patent Number: 5,205,103

[45] Date of Patent: Apr. 27, 1993

[54] SHINGLE LAYING APPARATUS

[76] Inventor: Rodney P. Burton, Ste. D, 6770 E. Livingston Ave., Reynoldsburg, Ohio 43068

[21] Appl. No.: 708,757

[22] Filed: May 31, 1991

[51] Int. Cl.[5] ..... E04D 15/00

[52] U.S. Cl. ..... 52/749; 182/45

[58] Field of Search ..... 52/746, 747, 748, 749; 182/45

[56] References Cited

U.S. PATENT DOCUMENTS

| | | | |
|---|---|---|---|
| 677,645 | 7/1901 | Elkins | 182/45 |
| 2,814,533 | 11/1957 | Van Horn | 182/45 |
| 3,245,192 | 4/1966 | Hilson | 52/748 |
| 4,785,606 | 11/1988 | Burton | 182/45 |
| 5,081,815 | 1/1992 | Carnell | 52/747 |

*Primary Examiner*—James L. Ridgill, Jr.
*Attorney, Agent, or Firm*—Francis T. Kremblas, Jr.

[57] ABSTRACT

A shingle laying apparatus includes a first horizontally extending track; a second track formed by a pair of longitudinal track members extending at right angles to the first track, and a carriage frame mounted on the second track. The second track is mounted for movement in a horizontal direction to the first track and carries the carriage frame for horizontal movement across the roof. The carriage frame is mounted to the second track for movement toward the first track between releasably fixed position associated with appropriate placement of a row of shingles across the roof. The carriage frame include a planar surface forming a tray to carry a load of shingles and provide a seat for an operator laying a row of shingles while moving the frame horizontally along the roof. In the preferred embodiment, a fastener gun assembly is pivotally mounted on the carriage frame in a position for quickly fastening each shingle which is laid on the roof. Upon finishing a horizontal row of shingles, the operator, via a rachet assembly mounted on the frame which cooperates with stop pins provided on the second track members, caused the carriage member to move along the second track a measured distance associated with the next adjacent row of shingles to be laid.

11 Claims, 5 Drawing Sheets

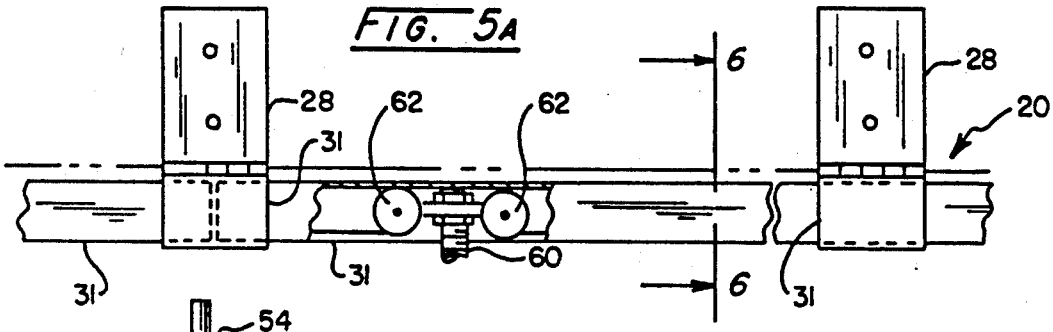
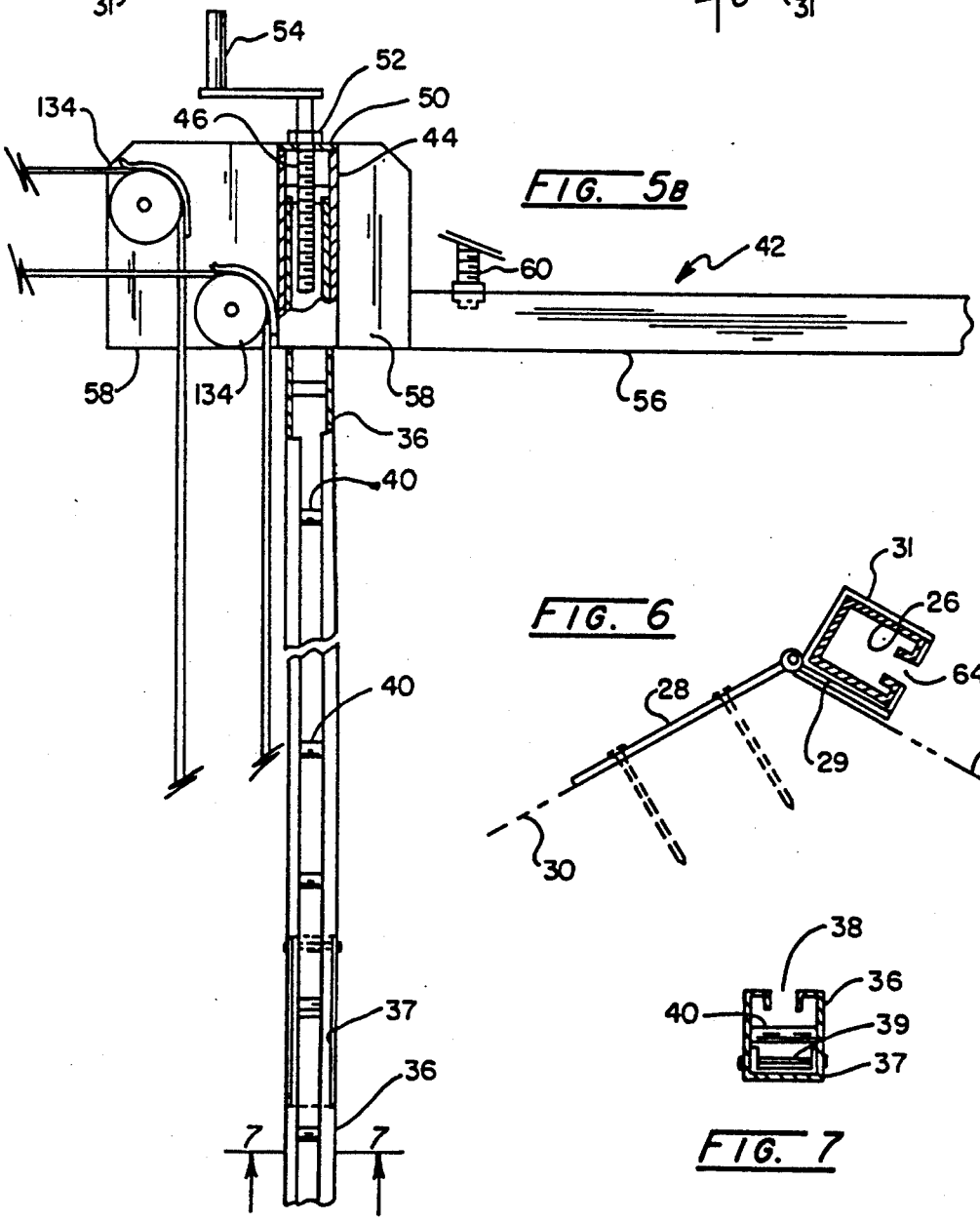
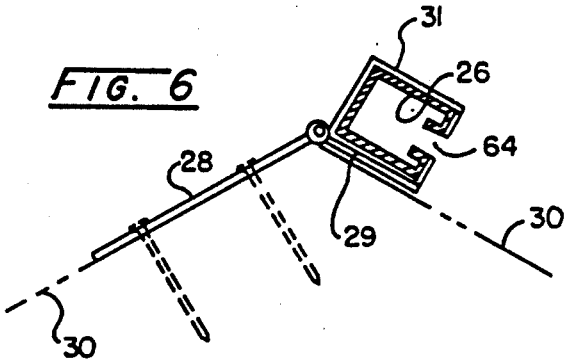
FIG. 7

SHINGLE LAYING APPARATUS

TECHNICAL FIELD

The present invention relates generally to apparatus useful to lay shingles or other similar roofing materials and particularly to an improved apparatus which reduces labor and improves the efficiency of laying shingles or the like.

BACKGROUND ART

The prior art includes many devices which aid a worker to align or guide the placement of shingles on a roof. The most pertinent prior art machine which also facilitates the transport of the operator and a load of shingles is disclosed in my prior U.S. Pat. No. 4,785,606. Many prior art patents relating to laying shingles are referenced in the above-identified patent.

The device disclosed in U.S. Pat. No. 4,785,606 represents a significant improvement over the prior art, however, it is somewhat cumbersome to transport and install upon a roof. Certain features thereof still require a less than satisfactory degree of effort and time on the part of an operator which do not maximize the rate at which the operator may lay and fasten shingles on a roof particularly after a complete horizontal row has been completed.

SUMMARY OF THE INVENTION

The present invention relates generally to an improved apparatus for the rapid laying of shingles or the like on a roof, and particularly to an apparatus which is less expensive to manufacture, easier to transport and install in an operating position on a roof, and is generally smaller and less heavy than prior shingle laying devices.

In accordance with the present invention, a horizontal guide rail or track is detachably mounted to a roof. In the preferred embodiment disclosed, a pair of vertically inclined track members form a second track extending at right angles to the horizontal track along the vertical pitch of the roof and are movably mounted to the horizontal track for movement parallel thereto. A carriage frame is mounted to the second track for movement therewith in a horizontal direction and is also mounted for independent movement vertically along the incline of the second track. The carriage frame includes a platform for carrying a load of shingles and an operator in a position permitting the operator to easily lay shingles as the carriage is moved in a direction parallel to the horizontal track. The frame preferably includes stop means cooperating with stop pins disposed longitudinally along the second track to releasably fix the carriage in a given position on the second track. A ratchet assembly is provided on the carriage frame which cooperates with the stop pins on the second track to provide means aiding the operator to move the carriage longitudinally along the second track at generally a right angle to the horizontal track to a predetermined position related to laying the next horizontal row of shingles.

In a particularly preferred embodiment, a fastener gun assembly carrying a plurality of conventional pneumatic guns is pivotally mounted on the carriage frame between a raised and lowered position to permit the operator to quickly and easily fasten each shingle to the roof in one motion before moving horizontally to the next adjacent shingle position.

Therefore it is an object of the present invention to provide an improved apparatus for laying shingles which is very compact and relatively easy to transport, install and use.

It is another object of the present invention to provide an apparatus of the type described which significantly increases the production rate of an operator to lay and fasten shingles in an accurate manner compared to the prior art.

It is still another object of the present invention to provide an apparatus of the type described which incorporates a carriage frame for easy transport of a load of shingles and the operator, wherein the frame is mounted to a simplified track system for easy movement horizontally along the roof as well as vertically to a new position aligned to lay another horizontal row of shingles without moving the track members.

It is a further object of the present system to provide an apparatus of the type described which includes a carriage frame which is slideably mounted to a pair of spaced track members extending vertically along the pitch of the roof and includes a set of wheels for engaging the roof to facilitate vertical movement along the pitch of the roof in a predetermined manner to more quickly and easily position the carriage to lay another row of shingles.

Further objects and advantages of the present invention will be apparent from the following description, reference being had to the accompanying drawings wherein preferred forms of embodiments of the invention are clearly shown.

BRIEF DESCRIPTION OF DRAWINGS

FIG. 5-A is a partial plan view of a portion of the apparatus shown in FIG. 5 illustrating the horizontal track and the roller guides of the trailer assembly removed from the remainder of the apparatus;

FIG. 5-B is a similar partial view as FIG. 5 illustrating a means for coupling individual track members forming part of the vertically inclined second track together;

FIG. 6 is a partial side sectional view of the horizontal track or guide forming a portion of the apparatus shown in FIG. 1 illustrating the track mounted to the roof; and FIG. 7 is an end sectional view of one of the vertically inclined track members forming a portion of the apparatus shown in FIG. 1 illustrating the pin members forming alignment and stop means which cooperate with members mounted on the carriage frame to accurately position the carriage frame along the vertical pitch of the roof.

Figure 1:
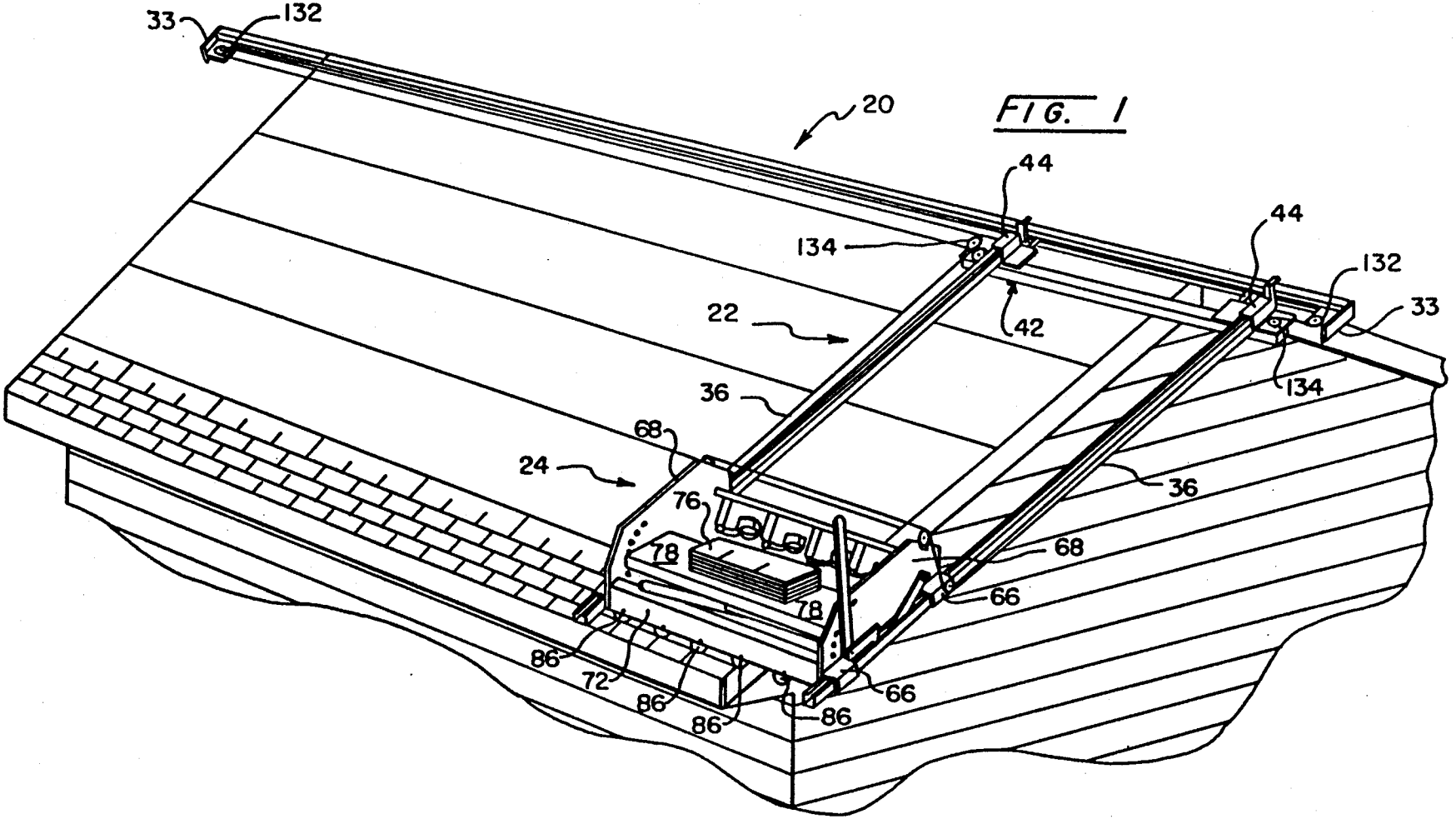
FIG. 1 is a perspective view of an apparatus for laying shingles constructed in accordance with the present invention shown mounted in an operable position on a roof.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

An improved shingle laying apparatus constructed in accordance with the present invention is shown in FIG. 1 and includes a horizontally disposed track or guide rail, indicated generally at 20, a pair of vertical inclined guides forming a vertical track indicated generally at 22, and a carriage frame member indicated generally at 24 and mounted for selective movement along the longitudinal length of vertical track 22.

Figure 5:
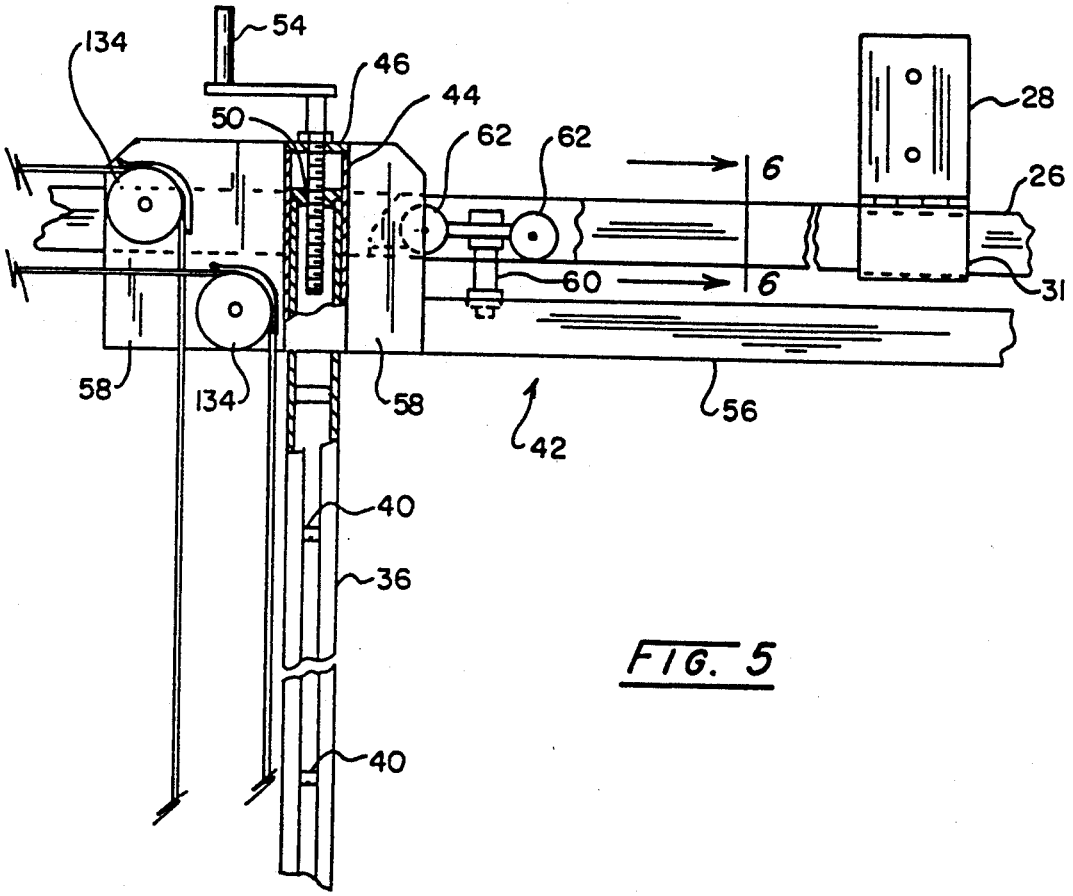
FIG. 5 is a partial plan view of a portion of the apparatus illustrated in FIG. 1, showing portions of the horizontal track and the vertically inclined track movably mounted thereto for horizontal travel along the roof.

Horizontal track 20, as shown in FIGS. 1, 5 and 6, comprises one or more tubular members 26 mounted to the roof via a plurality of hingedly connected mounting plates 28 and 29 spaced from one another horizontally across the width of a roof, indicated by ghost line 30. Plates 28 are detachably connected to the roof via conventional nails or similar fasteners 32. As shown, track 20 is mounted to the peak of the roof, however, it may be mounted at any desired lower level and moved upwardly as needed to complete laying shingles over the entire surface of the roof.

Track 20, preferably extends across the width of the roof and, for transporting and installation purposes, employs several tubular members 26 to form sections in lengths such as 8 to 12 feet, which are suitably mounted end to end via a tube-like coupling 31 comprising a hollow member which slideably accepts opposing ends of each tubular section 26. Coupling members 31 may be welded to mounting plate 29. Suitable flanges 33 are provided on the extreme ends of the track 20 to limit horizontal travel and to provide a support to mount pulleys described later herein.

Referring to FIGS. 1, 5, 5-A, 5-B and 7, a pair of identical guide members 36, each preferably comprising an elongate hollow member provided with a top opening 38, form a vertically inclined second track 22 extending along the pitch of the roof at generally a right angle to track 20. A plurality of stop pins 40 are conventionally fixed to and extend across each guide member 36 in spaced horizontally aligned relationship. The space between each pin 40 is related to the distance between conventionally sized and laid shingles, that is, about five inches to provide the desired overlap between adjacent horizontal rows of shingles. Preferably, guide members 36 are made between 8 to 12 feet in length with use of an appropriate internal coupling member 34 to form track 22 as long as necessary to cover the length of the roof along the pitch line. Coupling member 37 is slideably mounted within the opposing ends of adjacent members 36 and fixed by a pin extended through the members. Alternately, one length may be used, such as 12 feet for example, and horizontal track 20 may be moved to a higher location and track 22 re-installed to cover the next roof section.

A travel trailer assembly, indicated generally at 42, is provided and forms a means to mount each guide member 36 for horizontal movement along track 20. Trailer assembly 42 includes a pair of spaced tubular sockets 44 adapted to slideably accept the end of a respective one of guide members 36, such as seen in FIG. 5. Each guide member 36 is adjustably and releasably fixed within sockets 44 via threaded member 46 extending through the top of each socket 44 and adapted to threadably mate with a suitable threaded hole provided in an end cap 50 fixed on the end of each guide member 36. The outer end of socket 44 is provided with a threaded nut 52 and a crank handle 54 to facilitate adjustment of the threaded engagement between a respective member 46 and each end cap 50.

Travel trailer assembly 42 also includes a spacer or supporting bar 56 which may be fixedly connected in a suitably conventional manner to the side flanges 58 of sockets 44 to form a unitary assembly. A connecting bar 60 fixed in any conventional manner to bar 56 is provided with a pair of guide rollers 62 at its opposing end adapted to be accepted within tubular members 26 forming track 20 to allow relatively smooth travel of trailer assembly 44 along track 20. Connecting bar 60 extends outwardly of and freely moves along the opening 64 in tubular members 26.

Now referring to FIGS. 1–4, carriage frame 24 is mounted to tubular members 36 forming inclined track 22 for horizontal movement with track 22 across track 20 and for selective vertical movement longitudinally along track 22.

Carriage frame 24 include a pair of hollow sockets 66 welded or otherwise fixed to side panels 68 which are adapted to slideably receive a respective one of tubular members 36 forming inclined track 22. Frame 24 also includes a forwardly disposed support beam 70, a rearwardly disposed support beam 72 and a planar work surface or platform, indicated generally at 74, forming an area to carry a stack of shingles 76 and operator seat areas 78. Beams 70 and 72 are conventionally fixed to side panels 68 to form a rigid frame and platform 74 is pivoted at its forward end to side panels 68, such as at 80. The rearward end of work surface 74 is releasably fixed along an arc formed by holes 82 by selectively inserting a bolt and nut through one of the holes 82 and a mating hole 84 in the end of platform 74 to permit the operator to dispose the work surface 74 in a horizontal position relative to the pitch of the roof supporting carriage frame 24.

Carriage frame 24 is provided with a plurality of rotatable wheels 86 mounted to rearwardly disposed beam 72 and aligned to roll parallel to track 20. It is preferable to employ several wheels 86 to more evenly distribute the weight of carriage frame 24, and particularly the load occasioned by the operator sitting on platform 74 and the stack of shingles 76. Wheels 86 permit the carriage frame 24 to roll horizontally across the roof along with track 22 as guided by track 20 to enable the operator to lay a row of shingles in a quick and relatively effortless manner by merely pushing the carriage along with his feet as he lays each shingle taken from the stack of shingles 76.

Preferably, at least one pair of castor type wheels 90 are mounted on forwardly disposed beam 70. Castor wheels 90 will pivot to aid the movement of carriage frame 24 in either the horizontal path across the roof or the inclined path parallel to track 22 as described later herein as well as cooperate to support the weight of carriage frame 24.

Figure 2:
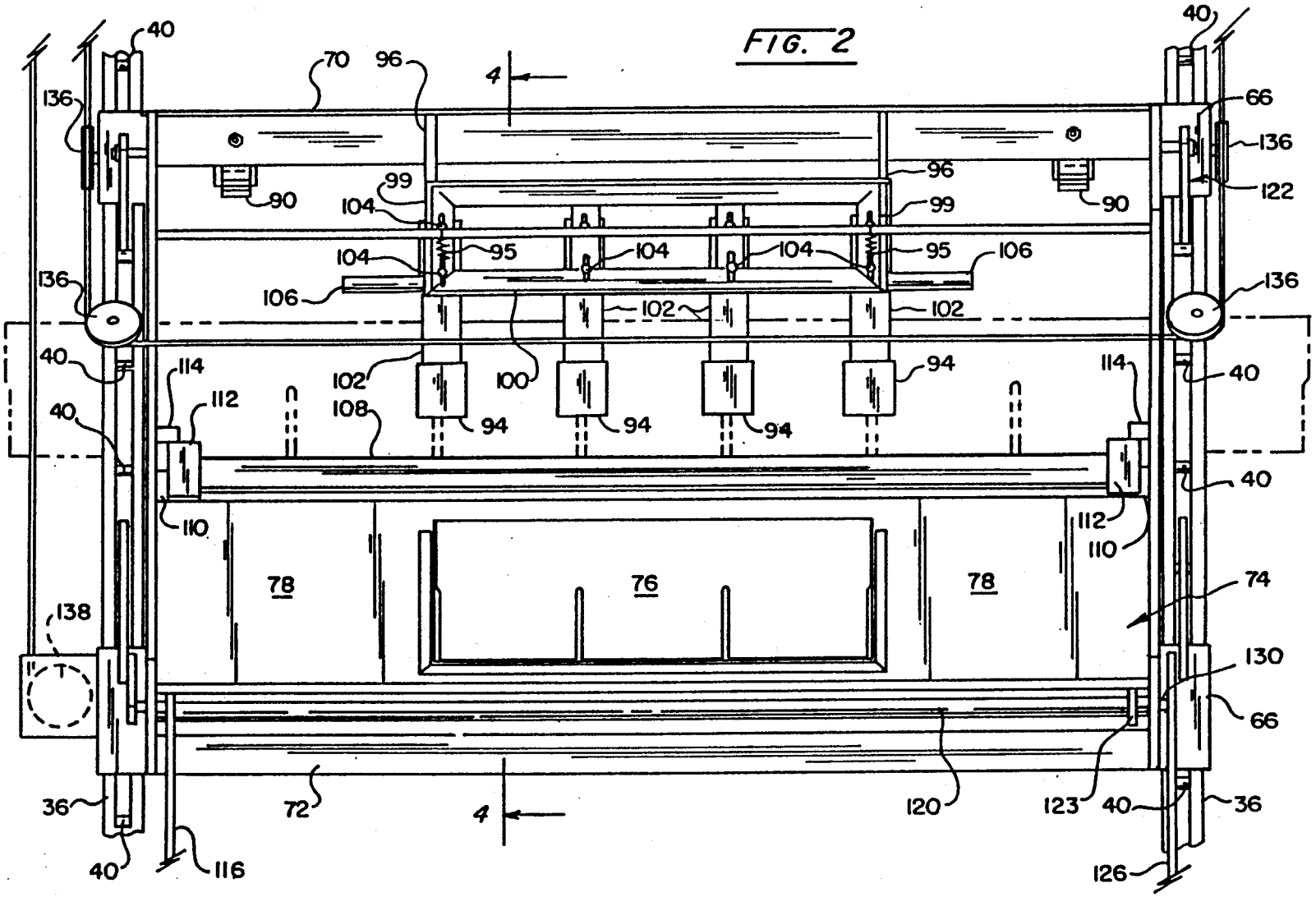
FIG. 2 is a partial plan view of a portion of the apparatus shown in FIG. 1 illustrating the carriage frame portion mounted on the track members extending along the pitch of the roof.
Figure 4:
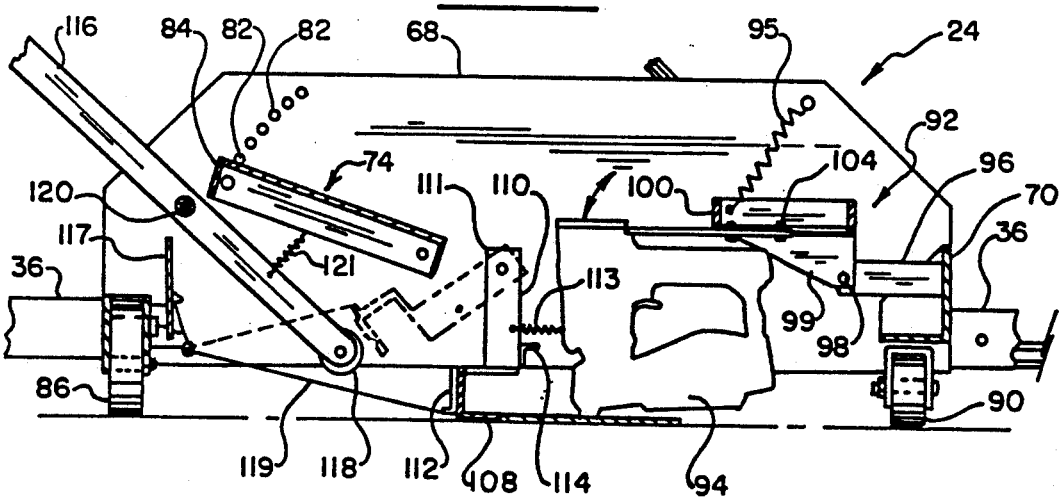
FIG. 4 is a side elevational view in section of the carriage member as illustrated in FIG. 2, the section taken along line 4—4 in FIG. 2.

Preferably, a fastener gun assembly, indicated generally at 92, is provided on carriage frame 24 and carries a plurality of conventional pneumatic powered nailing or staple guns 94 used for fastening shingles. As shown in FIGS. 2 and 4, four such guns 94 are mounted in spaced relationship and aligned with the appropriate spacing to deliver a roofing nail to the suitable place on a shingle laid on the roof.

Gun assembly 92 is pivotally mounted to plates 96 fixed to forwardly disposed beam 70 at pivot pin 98 and includes a pair of side plate 99, pivoted to plates 96 and a rack or frame 100 to which each gun 94 is mounted. A mounting plate 102, fixed at one end to each gun 94 via bolt 95 is fixed at its opposing end to rack 100 via a pair of threaded fasteners and bolts, such as 104. A handle bar 106 is provided at each end of rack 100 to facilitate pivoting the gun assembly 94 downwardly to engage the guns 94 with a shingle laid upon the roof. Preferably, gun assembly is biased via a spring or the like, such as at 95, in the raised position so that the operator merely has to pivot the assembly downwardly to engage the guns 94. Upon release by the operator, the assembly will return to its raised position via the action of the tension spring force.

A L-shaped alignment bar 108 is provided on carriage frame 24 and extends across its width. It is mounted on a pair of arms 110 each pivotally connected at 111 to side panels 68 between a raised position, shown in ghost lines in FIG. 4, and a lowered operable position. Bar 108 functions to provide an alignment guide for the operator to more quickly and accurately lay each successive shingle in a horizontal row as the operator moves across the roof.

Bar 108 is mounted to arms 110 via a pair of L-shaped brackets 112 which are welded to the bottom end of a respective arm 110.

Bar 108 may be fixed to brackets 112 in any conventional manner, such as being welded or bolted or the like.

An L-shaped bracket 114 is fixed to the inner side of side panels 68 to function as a positive stop means limiting the forward position of arms 110 to properly align bar 108 in an accurate position to guide the operator to lay a horizontal row of shingles.

Preferably, arms 110 and bar 108 are connected to a spring 113 biasing them to return to the lowered position engaging stop bracket 114. A lift or pivoting lever 117 may be mounted on the rearwardly disposed beam 72 and operatively connected to bar 108 via a cable 119 to permit the operator to lift bar 108 rearwardly as shown in FIG. 4 when the carriage frame is moved upwardly along track 22 as described in detail below so bar 108 will not disturb the shingles already laid and fastened.

Figure 3:
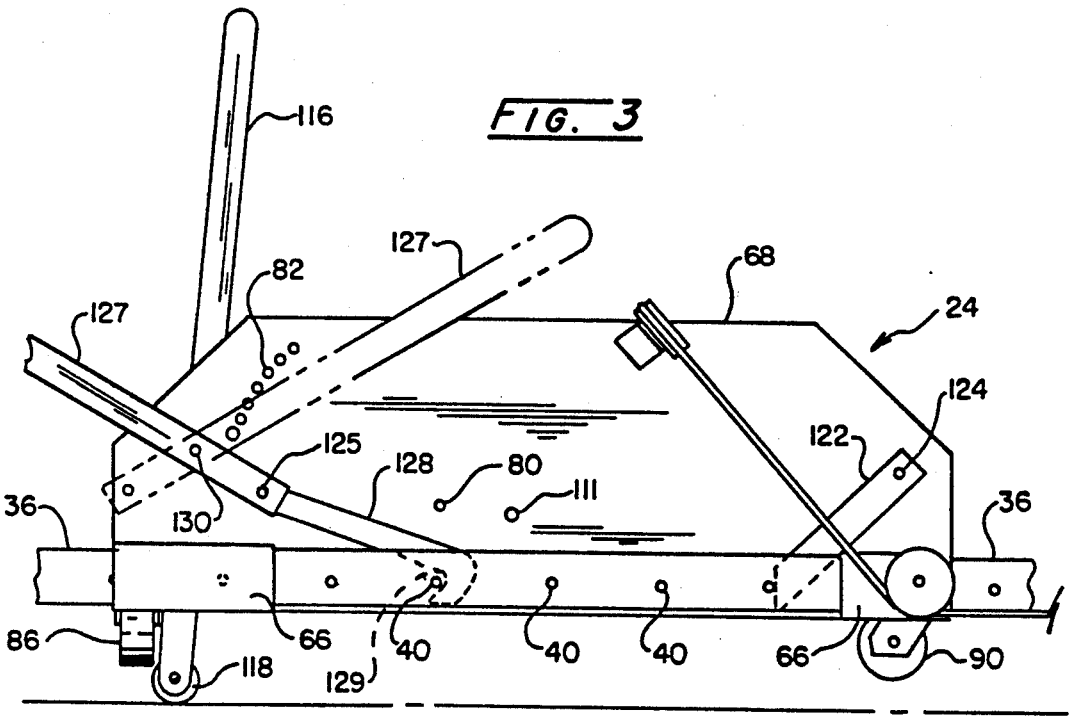
FIG. 3 is a side elevational view of the carriage frame shown in the preceding figures illustrating a portion of the frame.

Referring specifically to FIGS. 2–4, carriage frame 24 is provided with a wheel lift mechanism in the form of a lever 116 having a wheel 118 rotatably mounted on its lower end. Lever 116 is mounted to a shaft 120 rotatably mounted in any suitable conventional manner to side panels 68. At least one arm 123 disposed on the opposing end of shaft 120 or preferably, a plurality of arms 123, provided With Wheels 118 are welded or otherwise fixed to shaft 120 and spaced from one another to provide support across carriage frame 24. Upon pivoting lever 116 upwardly as seen in FIGS. 3 and 4 over its center or vertical position, frame 24 is lifted upwardly to clear rear wheels 86 from the roof as shown in FIG. 3. Rear beam 72 acts as a stop preventing further movement of wheels 118 and lever 116. A spring 121 connected to frame 24 and lever 116, biases lever 116 in the non engaged, raised position shown in FIG. 4.

In the lowered engaged position shown in FIG. 3, carriage frame 24 may be rolled upwardly on the roof guided by members 36 sliding through sockets 66. A stop lever 122 is pivotally mounted on the outer side of each side panel 68 at 124 with its lower end configured to easily slide over the stop pins 40 provided in tubular members 36 forming track 22 as carriage frame is moved to the right or upwardly on track 22 as seen in FIG. 3. However, the rearwardly facing surface 126 of stop lever 122 will engage the next adjacent lower stop pin to prevent movement of frame 24 to the left as seen in FIG. 3.

Therefore upon engaging lift wheels 118 via lever 116, carriage frame 24 may be rolled to the right, or upwardly along track 22 to the next adjacent stop pin 40 to accurately position the carriage frame at the next higher position to lay the next horizontal row of shingles.

To reduce manual effort and further act as a second safety stop preventing carriage frame to move to the left as seen in FIG. 3, a ratchet assembly is provided in the form of ratchet arms 127 and pawls 128 pivoted to the end of each arm 126 at 125. The opposing arm 127 on the opposite side panel is fixed to shaft 130 and does not require an extended handle portion as both may be actuated by one extended lever arm as seen in FIG. 3. Preferably ratchet arm 127 is connected to shaft 130 which is independently and rotatably mounted concentrically within shaft 120 to conserve space. Forward or upward pivoting of ratchet arm 127 cause pawls 128 to engage pin 40 upon which it rests and pulls carriage frame 24 upwardly or to the right as seen in FIG. 3. Continued movement of arm 127 carries each pawl 128 forwardly over and past the next adjacent pin 40 to the right as seen in FIG. 3. Upon return of arm 127 to its original lowered position, the hook face 129 of pawl 128 engages a pin 40 to releasably hold carriage frame 24 in its new advanced position preventing carriage 24 from movement to the left as seen in FIG. 4.

In operation, a user first attaches track 20 at a given elevation along the pitch of a roof. This position can be at the peak of the roof as illustrated in FIG. 6 or at a lower position dependent upon the length of track 22. Care should be taken to properly align track 20 parallel to the lower edge of the roof to assure that alignment of the laid shingles is proper.

Carriage member 24 is placed near its desired alignment near the lower edge of the roof. Trailer assembly 42 is engaged as previously described by inserting guide rollers 42 from the end of one of the members 26 before they are coupled or joined by insertion in tubular sleeve 31. Members 36 are then inserted through sockets 66 on the sides of carriage frame 24. The upper ends of each member 36 is then inserted into sockets 44 as previously described in alignment with the end of threaded member 46. Manipulation of crank handle 54 to effect engagement of member 46 into the threaded hole in cap member 50 completes the assembly of vertically inclined track member 36 and provides any small adjustment necessary to properly align the pins 40 with the similar pins in the other member 36.

With the carriage 24 mounted as described, an operator seats himself on one side of the stack of shingles 76 in a position to easily remove the top shingle 76 and lay it on the roof using alignment bar 108 as a guide. Then by merely pivoting gun rack 100 downwardly to engage pneumatic guns 94, the shingle is quickly and properly fastened. By propelling carriage frame 24 with his feet on the roof, the carriage frame is easily advanced to permit laying the next adjacent shingle in a horizontal row. The pneumatic guns are then actuated as previously described and the operator continues in this fashion until reaching the far end of the roof.

The operator preferably stands up and causes rear wheels 86 to be lifted upwardly by manipulating lever 116 as described herein which lowers wheels 118. Alignment bar 108 is also pivoted rearwardly away from the roof by actuating lever 117 and the carriage frame is ready to be advanced to the next higher level. Manipulation of ratchet arm 126 causes carriage frame to be advanced to the next adjacent pin 40 a distance of five inches for conventionally laid shingles.

Preferably, the operator shifts to the opposite side of the stack of shingles 76 to one of the seat areas 78 on platform 74 and continues to lay and fasten the next horizontal row of shingles. Then a similar procedure is followed to cause carriage frame 24 to advance to the next higher pin 40 upwardly along the slope of track 22.

Upon exhausting the stack of shingles, another square of shingles is loaded onto carriage frame 24 and the operator continues as before.

It should be readily apparent from the foregoing description that carriage frame 24 is constructed to move horizontally along the roof with track 22 on wheels 86 and castor type wheels 90 in a convenient and easy fashion. Similarly carriage frame is quickly and easily adapted to move vertically along the length of track 22 as described herein on wheels 118 and front castor 90, although on a strip pitch roof, caster wheels 90 may be lifted to a non-engaged position when wheels 118 are lowered.

The operator, being seated most of the time, is able to quickly and easily lay and fasten the shingles in a significantly improved and precise fashion compared to the methods and means of the prior art.

It should be pointed out that, if desired, a pulley system comprising, for example, pulleys 132 on track 20, 134 on trailer assembly 42, and 136 on carriage frame 24, may be employed to aid the operator in causing horizontal movement of carriage 24 and track 22 along track 20. A take-up reel 138 would also be mounted on carriage frame 24.

If desired, the movement of carriage frame 24, trailer assembly 42 and track 22 could be fully motorized. Such an arrangement would appear to be more practical in large in house operations such as conducted by modular home manufacturers and the like.

It should be noted that assembly time for track 20, track 22 and carriage frame 24 is approximately 10 to 12 minutes once all of the portions are disposed on the roof. Further, the carriage frame can be advanced to the next higher horizontal position in as little as about ten seconds. Using the gun rack assembly permits a single operator to increase his production rate dramatically compared to the prior art with significantly less effort.

Appropriate connections and hoses, not shown, can be conventionally mounted to gun rack 110 to supply air pressure from a compressor which is typically employed to power such guns in the conventional manual laying of shingles.

It should also be pointed out that the first two or three rows of shingles laid along the lower edge of the roof must be done manually to provide adequate space for carriage frame 24 to be safely supported on the roof. Also the last row of shingles adjacent to the peak of the roof would be manually laid after track 20 has been removed. However, the large remaining area of the roof can be shingled dramatically more quickly using the apparatus of the present invention to increase a typical workers production rate six to eight times over conventional manual procedures.

While certain preferred embodiments of the present invention have been disclosed in detail, it is to be understood that various modifications may be adopted without departing from the spirit of the invention or scope of the following claims.

I claim:

1. A shingle laying apparatus comprising, in combination;

a) a first track detachably connected to and longitudinally extending a predetermined distance horizontally across a roof;

b) a second track including at least one pair of longitudinally extending track members spaced from one another and disposed at generally right angles relative to said first track;

c) means for mounting said second track to said first track for movement across said roof parallel to said first track, each of said track members of said second track extending along the pitch of said roof and including an elongate channel having a top opening extending parallel to the length of said track member and a plurality of stop pins, each laterally extending across and fixed within said elongate channel in longitudinally spaced relationship to one another;

d) a carriage frame provided with a platform conformed to carry a load of shingles and connected to said at least one pair of track members of said second track for horizontal movement with horizontal movement of said second track along said roof in a path parallel to said first track and slidably mounted on said pair of track members for movement longitudinally along said second track in a perpendicular direction to said first track; and e) at least one lever arm pivotally mounted on each side of said carriage frame, each of said lever arms including a lower end extending downwardly and rearwardly into a respective one of said elongate channels of a respective track member and freely engaging a bottom surface of said elongate channel, said lower end conformed to engage a respective one of said laterally extending stop pins to prevent slideable travel of said carriage frame rearwardly from a higher to a lower position along said second track members.

2. The apparatus defined in claim 1 wherein said carriage frame includes wheel means for rolling engagement with said roof in a direction generally perpendicular to said first track.

3. The apparatus defined in claim 1 wherein said carriage frame includes a first set of wheel means for rolling engagement with said roof in a direction parallel to said first track and a second set of wheel means for rolling engagement with said roof in a perpendicular direction relative to said first track.

4. The apparatus defined in claim 1 wherein said carriage frame including a shingle alignment lip extending in a horizontal direction across said roof and aligned to direct the accurate placement of a row of shingles in a direction parallel to said first track.

5. The apparatus defined in claim 1 wherein said carriage frame includes a set of wheel means connected to said frame for rolling engagement with said roof in a direction parallel to said first track.

6. The apparatus defined in claim 5 wherein said set of wheels are mounted to said frame between a first non-roof engaging position and a second roof engaging position.

7. The apparatus defined in claim 1 wherein said carriage frame includes at least one automatic fastener gun assembly pivotally mounted to said carriage frame along an axis parallel to the length of said first track between a raised position above said roof and a lowered position engaging a shingle position on said roof to drive a fastener into said shingle.

8. The apparatus defined in claim 7 wherein said gun assembly is normally biased in said raised position.

9. A shingle laying apparatus comprising in combination, a carriage frame movable along defined horizontal and vertically inclined paths on a roof and including a platform conformed to carry a load of shingles and an operator; and a fastener gun assembly pivotally connected to said carriage frame adjacent to said platform along an axis parallel to said horizontal paths and biased in a normally raised non-operable position above said roof and pivotally movable to a lowered operable position, said assembly including a plurality of fastener gun units, each being horizontally spaced from one another in a predetermined relationship related to a length dimension of a shingle and automatically actuated upon pivoting of said assembly into said lowered position and said gun units into engagement with a shingle laid upon said roof to drive a plurality of fasteners into said shingle.

10. The apparatus defined in claim 9 including a horizontally disposed guide rail attached to said roof and at least one vertically inclined guide rail extending generally perpendicular to said horizontal guide rail along the pitch of said roof, said at least one vertically inclined guide rail movably attached at one end to said horizontal guide rail; and wherein said carriage frame is mounted to said vertically inclined guide rail for horizontal movement therewith and for vertical movement along said vertically inclined guide rail in a perpendicular direction relative to said horizontal guide rail.

11. The apparatus defined in claim 1 including a ratchet-like assembly comprising a first lever arm pivotally connected to said frame intermediate its ends, the lower end of said first lever arm pivotally connected to a second lever which includes a curved hook-like end, the open side of said hook-like end facing rearwardly and conformed to engage a respective one of said stop pins disposed in said elongate channel of said track member in force-transmitting engagement to effect slideable movement of said carriage frame on said second track toward the next forwardly disposed stop pin upon manual actuation of said first lever arm in a forward direction parallel to said second track.

* * * * *